United States Patent [19]

Wroclawski et al.

[11] 4,019,691

[45] Apr. 26, 1977

[54] METHOD AND APPARATUS FOR WINDING YARN ONTO A CROSS-AND-CONE WOUND BOBBIN

[75] Inventors: Zbigniew Wroclawski; Stanislaw Kedzia; Tadeusz Pawlowski, all of Lodz, Poland

[73] Assignee: Centralny Osrodek Badawxzorozwojowy Maszyn Wlokienniczych "Centamatex", Lodz, Poland

[22] Filed: Nov. 10, 1975

[21] Appl. No.: 630,648

[52] U.S. Cl. ..... 242/45; 226/24; 242/18 DD; 242/36

[51] Int. Cl.[2] ..... B65H 59/38

[58] Field of Search ..... 242/45, 36, 18 R, 18 DD, 242/18.1; 226/10, 24–26, 34; 28/1.7, 72.14

[56] References Cited

UNITED STATES PATENTS

| | | | |
|---|---|---|---|
| 3,166,821 | 1/1965 | Furlong | 28/1.7 |
| 3,280,444 | 10/1966 | Stanley | 28/1.7 X |
| 3,374,960 | 3/1968 | Stanley | 248/18.1 |
| 3,616,503 | 11/1971 | Mattingly | 28/72.14 |
| 3,703,023 | 11/1972 | Krauss et al. | 19/240 |
| 3,743,202 | 7/1973 | Hoffsommer et al. | 242/45 |
| 3,860,186 | 1/1975 | Schiltknecht et al. | 242/45 |
| 3,863,311 | 2/1975 | Cartlidge et al. | 28/1.7 |
| 3,905,560 | 9/1975 | Trifunovic et al. | 242/18 DD |
| 3,908,920 | 9/1975 | Hermanns | 242/45 |
| 3,945,579 | 3/1976 | Schippers et al. | 242/18 DD |

FOREIGN PATENTS OR APPLICATIONS

| | | | |
|---|---|---|---|
| 1,053,321 | 9/1953 | France | 242/18 DD |
| 1,085,684 | 7/1954 | France | 242/18 DD |
| 1,119,002 | 3/1956 | France | 242/18 DD |
| 1,213,199 | 10/1959 | France | 242/18 DD |

*Primary Examiner*—John Petrakes

[57] ABSTRACT

A method for winding yarn on a cross-and-cone wound bobbin, the yarn being fed at a constant speed from a spinning frame or from a texturing machine and temporarily held in a receptacle and then wound on the bobbin at a variable and controlled speed. The speed of winding is controlled by changing the position of the point of contact between the bobbin and a drive element, or by periodic breaking of contact between the bobbin and the drive element, the drive element rotating at a higher speed than the speed at which the yarn is fed, or by changing the rotational speed of the drive element in accordance with the deviations from the value of required filling of the receptacle with yarn. The apparatus includes a vacuum receptacle for the yarn equipped with a measuring sensor, a controller of the bobbin position including a pneumatic power device and a slider in which a holder of a cone element is rotably mounted, the controller being mounted on an arm and being connected with a piston rod of a power device. An analog system connects the measuring sensor with the power device.

8 Claims, 9 Drawing Figures

METHOD AND APPARATUS FOR WINDING YARN ONTO A CROSS-AND-CONE WOUND BOBBIN

This invention relates to a method for winding of yarn fed at a constant speed from a work station in a non-spinning frame in a yarn texturing machine, into a cross-and-cone wound bobbin. The invention also relates to an apparatus suitable for application of the method.

The cross-and-cone wound bobbins are most suitable for feeding of high-capacity machines. The unwinding of yarn is effected in these machines by pulling it along the axis of a usually fixed bobbin toward the smaller diameter, thus providing, a not too strong and, at the same time, uniform pull in the unwound yarn and allowing the use of high feeding speeds.

In spinning frames of non-spindle type, the yarn is continuously received at a constant speed from the spinning station, and is immediately wound, also at a constant speed, on a cross-and-cylindrical wound bobbin.

The winding system, situated behind a pair of shafts receiving the yarn from the spinning chamber, consists of a winding shaft turning at the same speed as that of yarn being received and in friction al contact with the bobbin mounted in a rotating holder of a swinging arm supporting the holder, and of a reciprocating yarn guide. A varying demand for the yarn is controlled by the motion of the yarn guide by the fixed position of yarn receiving shafts relative to the bobbin the varying demand being compensated by flexibility of the yarn which is thus wound with a lower or higher pull. Suitably formed guides are used for eliminating these pulls, the yarn sliding against these guides prior to winding, and thus an average demand for the yarn is maintained. In order to obtain the cross-and-cone wound bobbins, the wound yarn is then re-wound in winding machines. The motion of the yarn guide is in this case a periodic winding of yarn sections longer than the average demand for yarn in the zone of large diameters of bobbin, and of shorter yarn sections in the zone of small diameters of bobbin. Thus the yarn is taken up at various speeds depending on the momentary diameter of the cone of the receiving bobbin.

A cone wound bobbin can take up, from the winding system, the yarn in any amount required at a given moment, because the winding system receives the yarn directly from the feeding bobbin.

A disadvantage of this system is that the cross-and-cylinder wound bobbins obtained in a non-spindle spinning frame have to be re-wound in order to obtain the cross-and-cone wound bobbins which are convenient for further operations in production.

An object of this invention is to obviate the above mentioned disadvantage and to provide a method and an apparatus for direct winding of yarn into cross-and-cone wound bobbins.

In accordance with the method, the yarn is fed at a constant speed from the work station and is temporarily held in a transit receptacle, being then wound at a variable, controlled speed into a cross-and-cone wound bobbin. A momentary state of filling of the receptacle is measured and the speed of winding is controlled at an established value. The speed of winding subject to change in accordance with the change of the position of the contact point of bobbin with an element which drives the bobbin by friction along the generating line of the bobbin cone, or by periodic breaking of contact between the bobbin and the driving element, this driving element rotating at a constant speed higher than the speed yarn fed from the work station or also by changing of the the rotary speed of driving element whose maximum peripheral speed is higher than the speed of the fed yarn, and whose minimum speed is lower than the speed of yarn feeding. When the amount of the yarn becomes too high, the speed of winding rises above of that of yarn feeding and vice versa.

The method of the invention allows the yarn to be directly wound into a cross-and-cone bobbin in machines in which the yarn is fed at a constant speed, thus eliminating the need for rewinding of yarn. The yarn is wound at a constant pull and at a high speed, and bobbins of good quality are obtained.

The according to the invention includes a vacuum-type receiving shaft fitted with a measuring sensor, a unit regulating the position ot the bobbin and a comprising a piston-type pneumatic power device operating in one direction, a slider with a rotatably mounted holder for the bobbin, and as analog system for processing the measurment signal and connecting the measuring sensor with the pneumatic power device. The slider is connected with the piston rod of the pneumatic power device and slidably mounted on a swinging arm in which the portion guiding the slider is perpendicularly situated relative to the winding shaft, the axis of the bobbin forming with the axis of the winding shaft on acute angle thus providing a point contact between these two elements. The measurment of the state of the yarn receptacle filling can be obtained by means of a pneumatic, volumetric or a photo-electric sensor. A pneumatic sensor constitutes at least one channel-type measuring tip suitably shaped in the housing of the yarn receptacle, preferably in the wall of the yarn holding chamber. A volumetric sensor includes at least two condenser plates mounted in the receptacle housing, the yarn within the receptacle being contained between these condenser plates. A photo-electric sensor consists of at least one source of visible radiation and of at least one semiconductor photo-element situated opposite one another in the receptacle housing, the yarn being contained in the receptacle between these two elements.

In accordance with a modified embodiment of the apparatus a two-arm lever is provided on the swinging arm, one arm of said lever being preferably positioned in parallel to the swing arm and being connected with the piston rod of the pneumatic power device, the other arm of the said lever being fitted with a friction pad mounted opposite a brake disc fixed to a rotating holder of the bobbin. The further includes a stop element installed in the path of motion of the two-arm lever, to brake the bobbin at the moment when the contact between the bobbin and driving element is broken. The active chamber of the power device is connected, through a pulse system of signal processing, with the measuring sensor, while an inactive chamber of the power device is connected, through a pressure regulator, with the source of pressure.

The present invention will now be described by way example and with reference to the accompanying drawing in which.

Figure 4:
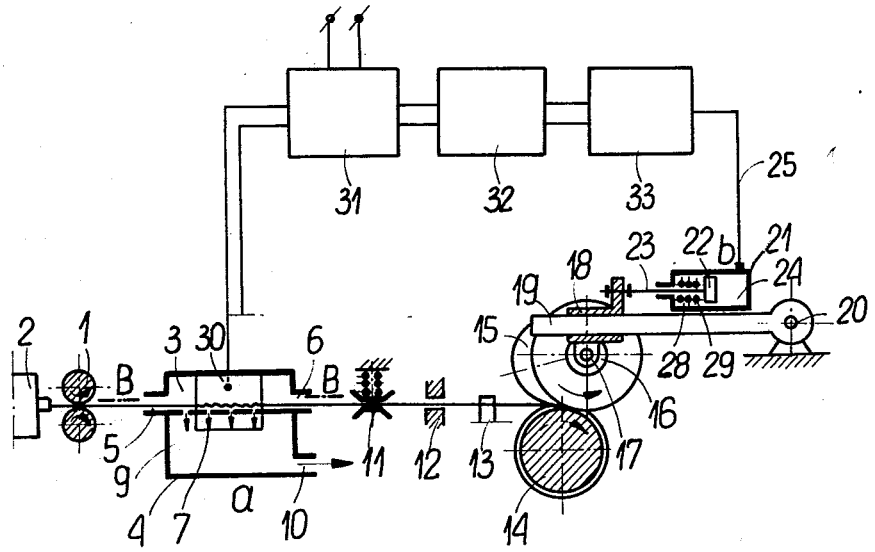
Figure 5:
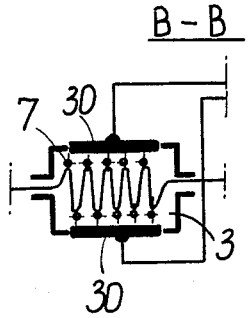
Figure 6:
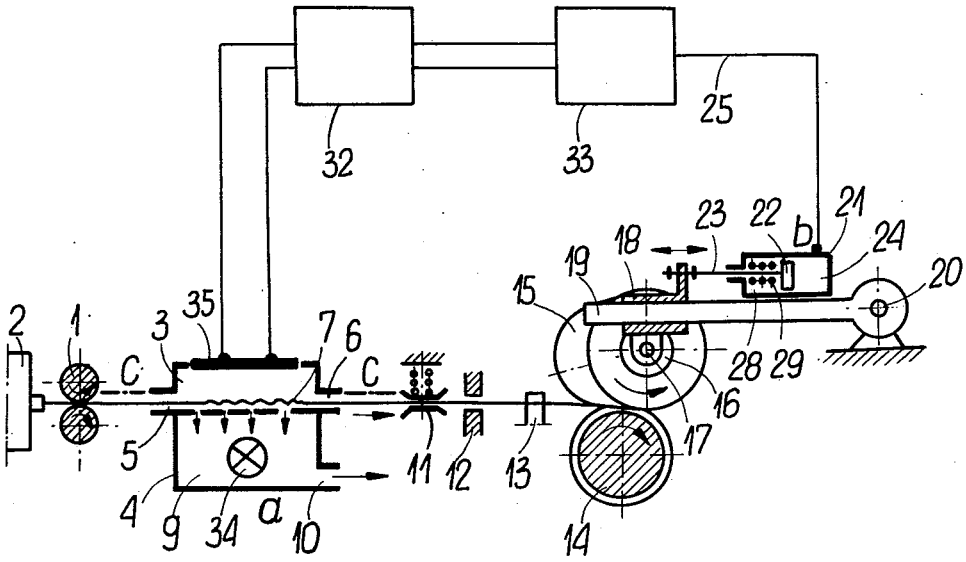
Figure 7:
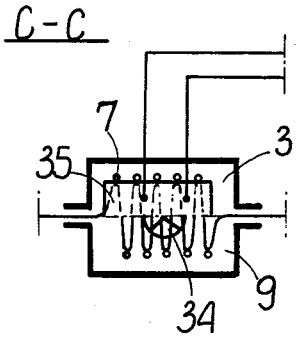
Figure 8:
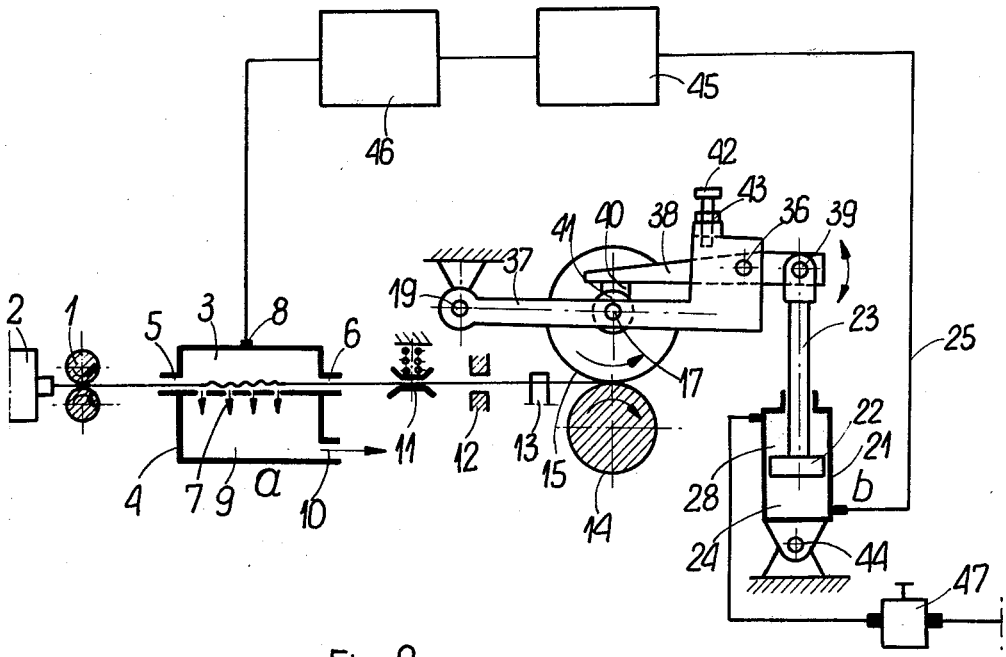
Figure 9:
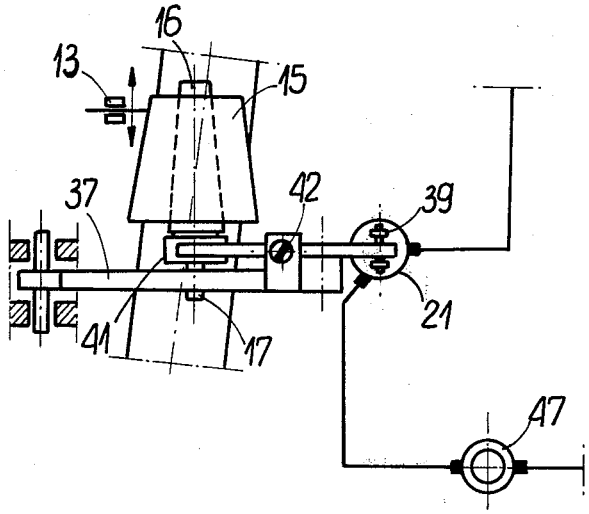

3 illustrates a portion of the apparatus in plan view;

FIG. 4 illustrates in a side view the apparatus with a volumetric sensor;

FIG. 5 is a section taken along line B—B FIG. 4;

FIG. 6 illustrates in a side view the apparatus with a photo-electric sensor;

FIG. 7 is a section taken along line C—C in FIG. 6;

FIG. 8 is a side view of a modified version of apparatus with a pneumatic sensor; and FIG. 9 illustrates in plan view a portion of the apparatus of FIG. 8.

Figure 1:
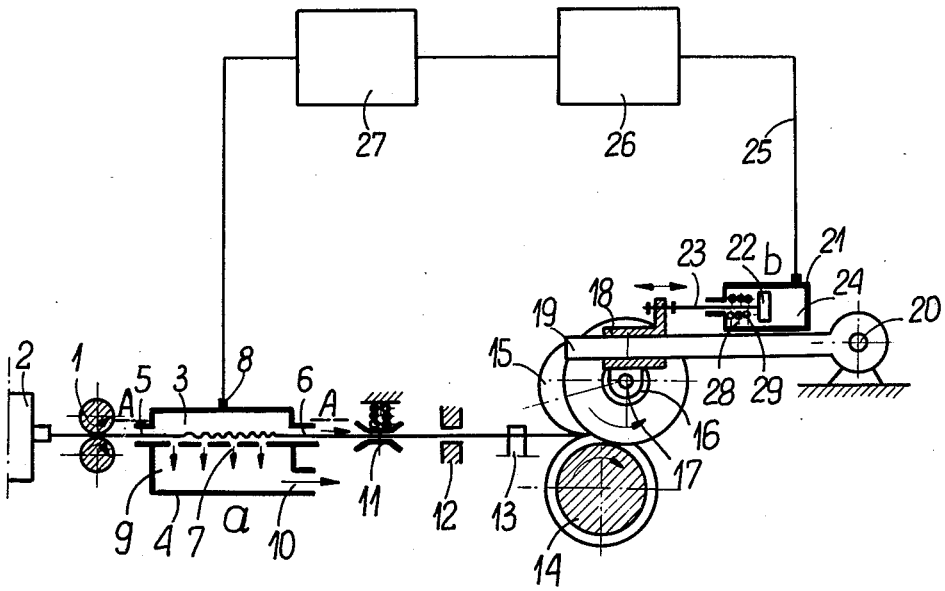
FIG. 1 illustrates in a side view apparatus according to the invention with a pneumatic sensor.
Figure 2:
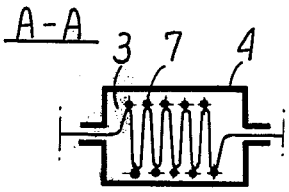
FIG. 2 is a section taken along line A—A in FIG. 1.
Figure 3:
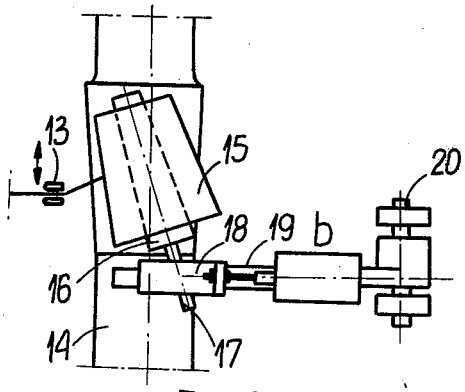

In the apparatus illustrated in FIGS. 1—3, there is shown a yarn receptacle installed behind a pair of receiving shafts 1 situated at the yarn delivery side of a fixed spinning chamber 2. The receptacle *a* has a rectangular yarn holding chamber 3 confined in a housing 4. In the end walls of chamber 3 there are, respectively, an inlet hole 5 and an outlet hole 6 for the yarn, said holes being concentric. In the bottom wall of the yarn holding chamber 3 there are two rows of yarn laying parts 7, and there is a channel-type measuring tip 8 installed in the top wall of the said chamber. A suction chamber 9 adjoins the yarn holding chamber 3, said suction chamber being separated from the yarn holding chamber by a bottom wall and being confined in a housing 4 of the receptacle, said suction chamber 9 being terminated with a stub pipe 10 connected to a vacuum source. Situated behind the receptacle *a*, in the path of the yarn, is a disc-type tensioner 11, a pointed clearer 12, and a winding system. The winding system comprises a reciprocating yarn guide 13 distributing the yarn, a winding shaft 14 rotating at a constant speed, said winding shaft being in a point contact with cone wound bobbin 15, said point contact being achieved due to the offset position of the center lines of these two elements. The winding shaft 14, extends across the whole length of the spinning frame and is cone-shaped in sections co-operating with bobbin 15, the apex angle of the cone being 10°, Bobbin 15 is wound on a cone element 16 mounted on a holder 17, said holder being rotably mounted on a slider 18. Slider 18 is slidably mounted on an arm 19 swinging on a pin 20 installed in the casing of the spinning frame, said pin being parallel to the center line of winding shaft 14. The end portion of arm 19 actuating the slider 18 is perpendicular to the center line of winding shaft 14, said center line forming an acute angle with the center line of bobbin 15. A cylinder 21 of a pneumatic power device *b* is mounted on the arm 19, said cylinder containing a piston 22 with piston rod 23, the free end of the said piston rod being connected to slider 18. At one side of piston 22 a chamber 24 of power device *b* is connected, through a conduit 25, with a pneumatic pressure converter 26, the outlet of said converter being connected, through an amplifier 27, with measuring tip 8 in the receptacle *a*. A return spring 29 is installed in chamber 28 at the other side of piston 22, said spring supporting and returning the said piston.

The apparatus illustrated in FIGS. 4 and 5. includes, in the yarn holding chamber 3 of receptacle *a*, two plates 30 of a capacitor, said plates being mounted in the housing 4 of receptacle *a* and connected, through a feeder 31, with an amplifier 32. The output of amplifier 32 is connected, through an electro-pneumatic converter 33, with the chamber 24 of power device *b*.

The apparatus as illustrated in FIGS. 6 and 7 includes a light source 34 installed in the suction chamber 9, a semi-conductor photo-element 35 installed opposite the light source on the top wall of yarn holding chamber 3. The photo-element is connected, through the amplifier 32, with the electro-pneumatic converter 33, the output of the said converter being connected with the chamber 24 of power device *b*.

The apparatus operates as follows:

The yarn taken up from spinning chamber 2 by the pair of receiving shafts 1, is continuously fed to the yarn holding chamber 3 of the receptacle *a*. As a result of the vacuum the yarn is formed between two rows of yarn laying parts 7, into loops tightly adjoining one another. Simultaneously, the yarn is removed from the holding chamber 3 at a variable speed, as a result of rotational motion of bobbin 16 driven by friction by the winding shaft 15. The removed yarn which passes the tensioner 11 and clearer 12 is distributed along the bobbin 15 by the yarn guide 13. The bobbin 15, which is in point contact with the winding shaft 14, is moved along the generating line of the bobbin cone and the rotational speed of the bobbin 15 is thus changing, the motion of the bobbin depending on the deviation of the value of the amount of yarn contained in receptacle *a* from an average value. The amount of yarn held in receptacle *a* may be measured by measuring the vacuum in the receptacle *a*, by measuring the voltage of capacitor 30, or by measuring the output voltage at the photo-element 34, the pneumatic-vacuum signal being converted, after being amplified, into proportional pneumatic-pressure signals fed to power device *b*, the electric signals being converted, after being amplified, into proportional pneumatic-pressure signals also fed to the power device *b*.

When the amount of yarn contained in receptacle *a* has an average value, the tension of return spring 29 is balanced by the air pressure in chamber 24 of power device *b*, and the piston 22 with piston rod 23, as well as the slider 18 with bobbin 15 stop in a mid position at which the contact point of the generating line of bobbin 15 with the generating line of winding shaft 14 is halfway of along bobbin 15. As soon as the amount of yarn contained in receptacle *a* begins to decline, the air pressure increases causing displacement of piston 22, against the force of return spring 29, together with piston rod 23, slider 18 and the bobbin 15. The contact point of bobbin 15 moves towards the smaller diameters of the winding shaft 14, and toward the larger diameters of bobbin 15, the speed of winding decreasing and the amount of yarn contained in receptacle *a* increasing. When, on the other hand, the amount of yarn contained in receptacle increases the pressure drops and the return spring displacer 29 piston 22 together with piston rod 23, and the slider 18 together with bobbin 15,. The contact point of bobbin 15 moves towards the large diameters of winding shaft 14 and towards the smaller diameters of bobbin 15, the speed of winding increasing and the amount of yarn contained in receptacle *a* gradually beginning to decrease.

In a modified embodiment of the apparatus as illustrated in FIGS. 8 and 9, a two-arm lever 38 is rotatably mounted on a pin 36 fixed on an arm 37, one arm of the said two-arm lever 38 being connected by a pin 39, to piston rod 23 of the pneumatic power device *b*, the other arm of the said two-arm lever being provided with a friction pad 40 fixed to the said arm. The friction pad 40 is situated opposite a brake disc 41 mounted on a revolving holder 17 of bobbin 15,. A bolt 42 locked by a nut 43 is also installed on the arm 37, the end of the bolt being situated opposite the lever 38 at the side opposite that at which the friction pad 40 is fixed to the arm of the lever. There cylinder 21 of the power device *b*, containing piston 22 with piston rod 23, is articulated on a pin 44 fixed to the body of the spinning frame. The active chamber 24 of power device *b* is formed below the piston and is connected by means of a conduit 25, to the output of pneumatic pulse generator 45, the output of the said generator being connected, via an amplifier 46, with the channel type measuring tip 8, while an inactive chamber 28 of the power dentice connected via a pressure regulator 47 with the pressure source (not shown) The pressure regulator regulates the value of pressure in the inactive chamber 28, thus regulating the magnitude of pressre of bobbin 15 against the shaft 14, the octine chamber 24 of power device *b* can also be connected, through a pulse system of signal processing with, a volumetric or a photo-electric sensor receptacle *a*. When the yarn is being wound, the bobbin 15 either contacts the winding shaft 14, or the contact between these two elements is broken peroidically depending on the momentary amount of yarn contained in receptacle *a*. The momentary amount of yarn contained in receptacle *a* can be measured by measuring the vacuum produced in receptacle *a*, or by measuring the voltage of capacitor 30 or the volage across the photo-electric element 34, the pneumatic signals being, after amplification, fed to the pneumatic pulse generator 45, said generator sending pneumatic pressure pulses to the chamber 24 of power device *b*, while the electric signale are converted, after their amplification, into pneumatic, pulses, said pulses being also fed to the power device *b*.

The pulse generator sends the actuating pulses only when the measuring signal reaches the required value.

When the amount of yarn contained in receptacle *a* reaches a value beyond the range, the pulse generator ceases to operate, the bobbin 15 is pressed against the shaft 14 and takes up the excess of yarn from receptacle *a*. In this case, the air compressed within the inactive chamber 28 of power device *b* acting against the piston 22 causes piston rod 23 to move to the bottom position and then after the arm of lever 38 is stopped against the stop bolt 42 and when the brake is released, the bobbin 15 is pressed against the winding shaft 14.

As soon as the amount of yarn contained in receptacle *a* decreases beyond the lower range of receptacle *a* filling, the pulse generator begins to operate and periodic pneumatic pressure pulses are sent to the active chamber 24. Piston 22 moves up, the lever 38 moves away from stop bolt 42 and presses the friction pad 40 against the brake disc 41, the bobbin 15 no longer being driven for the time of pulse duration and is braked, thus causing the amount of yarn contained in receptacle *a* to increase.

What we claim is:

1. A method of winding yarn fed at a constant speed from a work station onto a conical shaft to form a cross-and-cone wound bobbin, said method comprising driving the bobbin by frictional contact thereof with a drive element driving said drive element around an axis of rotation which is inclined at an acute angle with the axis of rotation of the bobbin such that the frictional contact of the bobbin with the drive element is at a point along a generating line of the bobbin cone, passing the yarn from the work station to the bobbin through a transit receptacle where the yarn is temporarily accumulated, measuring the degree of filling the yarn in the receptacle, and varying the winding speed of the bobbin to compensate for the varying diameters of the bobbin while keeping a constant feed of the yarn by displacing the bobbin cone to change the position of the contact point of the drive element along the generating line of the bobbin cone in response to the measured degree of filling of the yarn in the receptacle to maintain a substantially constant degree of filling therein.

2. A method of winding yarn as claimed in claim 1 wherein suction pressure is maintained in the receptacle for accumulation of the yarn therein, the degree of filling of the yarn in the receptacle being effected by sensing change in suction pressure prevailing in the receptacle due to variation of the degree of filling.

3. Apparatus for winding yarn fed at a constant speed from a work station as a cross-and-cone wound bobbin, said apparatus comprising a pair of yarn take-up shafts for feeding yarn at a constant speed, a vacuum receptacle for receiving the yarn and temporarily accumulating the yarn therein, said receptacle comprising a holding chamber through which the yarn travels, a suction chamber and a wall separating the holding chamber and the suction chamber, said wall having two rows of yarn laying parts for forming loops of yarn due to suction in the holding chamber, means for measuring the degree of filling of said yarn in said holding chamber, a conical drive shaft, a conical support shaft for receiving yarn from the holding chamber and for winding the yarn on the support shaft, said shafts having axes which are inclined at an acute angle relative to one another, said drive shaft being in peripheral contact with said yarn wound on the support shaft at a point along the generating line of the conically wound bobbin to drive the bobbin in rotation, and control means for displacing said conical shaft relative to said drive shaft to vary the position of the contact point of the drive element along the generating line of the conically wound bobbin to compensate for varying winding diameters of the conical bobbin while keeping a constant feed of the yarn, said control means being coupled to said means which measures the degree of filling of the yarn in said holding chamber to maintain said degree of filling substantially constant by varying said position of said contact point.

4. Apparatus for winding yarn as claimed in claim 3 wheren said control means acts to displace said conical shaft perpendicularly to the axis of the drive shaft.

5. Apparatus for winding yarn as claimed in claim 4 wherein said control means comprises a holder for rotatably supporting said conical shaft for rotation thereof around its axis, a pivotable arm extending perpendicular to the axis of the drive shaft, a slider carrying said holder and displaceable on said arm, and a power unit on said arm operatively connected to said slider and to said measuring means.

6. Apparatus for winding yarn as claimed in claim 5 wherein said measuring means comprises a pressure measuring sensor coupled to said holding chamber.

7. Apparatus for winding yarn as claimed in claim 5 wherein said measuring means comprises a capacitor including two plates disposed in said holding chamber for passage of the yarn therebetween, a feeder connected to said capacitor, and an electro-pneumatic converter coupled to said feeder and to said power unit.

8. Apparatus for winding yarn as claimed in claim 5 wherein said measuring means comprises a light source in said suction chamber and a photosensitive element opposite said light source at a location arranged so that the yarn travels between the light source and the photosensitive element.

* * * * *